US006623258B1

(12) United States Patent
Iversen et al.

(10) Patent No.: US 6,623,258 B1
(45) Date of Patent: Sep. 23, 2003

(54) AXIAL PISTON REFRIGERANT COMPRESSOR WITH PISTON FRONT FACE PROJECTION

(75) Inventors: Frank Holm Iversen, Padborg (DK); Preben Bjerre, Sønderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 0 days.

(21) Appl. No.: 10/009,667

(22) PCT Filed: May 22, 2000

(86) PCT No.: PCT/DK00/00271

§ 371 (c)(1),
(2), (4) Date: Nov. 13, 2001

(87) PCT Pub. No.: WO00/71896

PCT Pub. Date: Nov. 30, 2000

(30) Foreign Application Priority Data

May 25, 1999 (DE) ..... 199 23 611

(51) Int. Cl.[7] ..... F04B 53/10
(52) U.S. Cl. ..... 417/559; 92/181 R
(58) Field of Search ..... 417/559; 92/181 R

(56) References Cited

U.S. PATENT DOCUMENTS

| | | | | | |
|---|---|---|---|---|---|
| 2,190,537 | A | * | 2/1940 | Wiebicke | 123/261 |
| 5,149,254 | A | | 9/1992 | Riffe | 417/569 |
| 5,203,857 | A | * | 4/1993 | Terwilliger et al. | 417/552 |
| 5,447,130 | A | * | 9/1995 | Kawamura | 123/269 |
| 5,816,783 | A | * | 10/1998 | Oshima et al. | 417/415 |

FOREIGN PATENT DOCUMENTS

| | | | | | |
|---|---|---|---|---|---|
| DE | 527 635 | | 6/1931 | | |
| DE | 3526255 | A1 * | 1/1986 | | |
| DE | 35 26 255 | A1 | 1/1986 | | F04B/39/10 |
| DE | 195 15 217 | A1 | 10/1996 | | F04B/27/00 |
| DK | 9200898 | | 1/1993 | | F04B/27/08 |
| GB | 993 887 | | 6/1965 | | |
| GB | 2083566 | A * | 3/1982 | | |
| GB | 2 083 566 | A | 3/1982 | | F04B/39/10 |
| WO | 96/34200 | A1 | 10/1996 | | F04B/39/10 |

* cited by examiner

*Primary Examiner*—Charles G. Freay
*Assistant Examiner*—John F Belena
(74) *Attorney, Agent, or Firm*—McCormick, Paulding & Huber LLP

(57) ABSTRACT

The invention relates to a refrigerant compressor comprising at least one piston-cylinder unit and one valve plate that has at least one outlet opening. The piston has a projection which projects into the outlet opening when the piston is located near the upper dead center thereof. The aim of the invention is to increase the efficiency and to reduce the noise level. To these ends, the invention provides that the outlet opening, piston projection, valve plate and piston delimit a flow channel, and provides that the free cross-sectional area of the flow channel is determined by the smallest cross-sectional area of the outlet opening until the piston, during its pressure stroke at least the height (H) of the outlet opening, is located underneath the upper dead center. The invention also provides that, during the remainder of the pressure stroke of the piston, the relative reduction of the free cross-sectional area of the flow channel is less than the relative reduction in volume of the pressure chamber, and provides that at least 45% of the volume of the outlet opening is occupied by the projection when the piston is located in the upper dead center thereof.

6 Claims, 4 Drawing Sheets

PRIOR ART

AXIAL PISTON REFRIGERANT COMPRESSOR WITH PISTON FRONT FACE PROJECTION

CROSS-REFERENCE TO RELATED APPLICATION

This application is entitled to the benefit of and incorporates by reference essential subject matter disclosed in German Patent Application No. 199 23 611.9 filed on May 25, 1999, and International Application No. PCT/DK00/00271 filed on May 22, 2000 in the name of Danfoss Compressors GmbH.

FIELD OF THE INVENTION

The invention relates to an axial piston refrigerant compressor comprising at least one piston-cylinder unit, whose cylinder is closed by a valve plate that has at least one discharge valve with an outlet opening, a projection of the piston extending into the outlet opening, when the piston is near its upper dead center.

BACKGROUND OF THE INVENTION

From DE 195 15 217 A1 is known a compressor of this kind, in which the piston has an asymmetric projection, which cooperates with the outlet opening of the discharge valve. The outlet opening is adapted to the asymmetric projection of the piston.

From the patent application DK 898/92 is known an axial piston compressor with a conical piston projection, which cooperates with a conical outlet opening of the discharge valve.

From U.S. Pat. No. 5,149,254 is known an axial piston compressor with a recess in the part of the piston front face, which extends from the outlet opening of the discharge valve to the centre of the piston front face. In this recess a piston projection may be provided, which cooperates with the outlet opening.

In these known compressors, the piston projection is supposed to occupy the outlet opening to the largest possible extent in the upper dead centre, to avoid its "dead volume", that is, also to push out the gas contained in the opening and thus to increase the efficiency of the compressor.

The virtual (free) cross-sectional area of the outlet opening is reduced, when the piston approaches its upper centre, so that the flow resistance in the outlet opening increases. The flow conditions in the outlet opening and around the valve closure element may cause the discharge gas to create recirculation zones in part of the outlet opening. The piston projection may aggravate this problem in that the distance between the projection and the outlet opening has already decreased to a flow restriction before the projection has reached the outlet opening. Thus, the free cross-sectional area of the outlet opening may already be substantially restricted, before the discharge valve opens.

The invention is based on the task of providing an axial piston refrigerant compressor of the kind mentioned in the introduction, which has an even higher efficiency.

SUMMARY OF THE INVENTION

According to the invention, this task is solved in that the outlet opening, the piston projection, the inside of the valve plate and the front face of the piston delimit a flow channel having a continuous extension of its axial section edges at least over the major part of its circumference. The free cross-sectional area of the flow channel is determined by the smallest cross-sectional area of the outlet opening, at least until the piston, during its pressure stroke, has reached a position, which lies below the upper dead centre by at least the height of the outlet opening. During the further pressure stroke of the piston the relative decrease of the free cross-sectional area of the flow channel is smaller than the relative decrease of the volume of the pressure chamber. In the upper dead centre of the piston, at least 45% of the volume of the outlet opening is occupied by the projection.

This solution gives a flow channel with a minimum flow resistance, a smaller pressure loss in the outlet opening and a smaller "dead volume". The maximum outflow velocity of the gas gets smaller. At the same time, a noise reduction is obtained. On the whole, the improved efficiency of the compressor is improved.

Preferably, the cross-sectional area of the outlet opening decreases in the direction of the outside of the valve plate. It is also preferable that the cross-sectional area of the projection decreases towards its free end and that the cross-sectional areas of the outlet opening and the projection change in the axial direction in such a way that during the piston movement the free cross-sectional area of the flow channel changes relatively less than the volume remaining in the cylinder. Thus, the flow resistance of the flow channel remains at a low level, while during the pressure stroke of the piston the flow or the mass flow decreases.

During the pressure stroke of the piston, the flow resistance of the flow channel can be determined by the smallest cross-sectional area of the outlet opening, until the free end of the piston projection is aligned with the inside of the valve plate. This gives an optimum gas discharge while the mass flow through the outlet opening is at its maximum.

In particular, during the pressure stroke of the piston, the flow resistance of the flow channel can be determined by the smallest cross-sectional area of the outlet opening, until 50% of the height of the piston projection has penetrated into the outlet opening. This gives an optimum gas discharge, until the piston speed has decreased substantially and the gas flow has decreased.

In an embodiment of the present invention, an axial section through the outlet opening of the valve plate and the piston projection has curved section edges. Therefor, the edge of the outlet opening can be steeper than that of the projection.

In particular, the compressor according to the invention can be designed in such a way that the junction surface between the valve plate surface and the outlet opening and the junction surface between the piston front end and the projection have a continuous shape, the junction surface between the outlet opening and the valve seat and the junction surface between the projection and the piston front end being rounded. Thus, gas discharge during draining of the cylinder can take place almost without creating eddies, thus decreasing the flow resistance.

The outlet opening can have an asymmetrical shape. This is advantageous, when the outlet opening is offset in relation to the centre of the cylinder.

Alternatively, the outlet opening can have a symmetric shape. This is advantageous, when the outlet opening is placed close to the center of the cylinder.

Also the piston projection can have an asymmetrical shape. Thus, the projection can be adapted to an asymmetrical outlet opening.

When the piston projection is symmetrical, it can be adapted to a symmetrical outlet opening.

It is also possible to combine a symmetrical piston projection with an asymmetrical valve opening and vice versa.

BRIEF DESCRIPTION OF THE DRAWINGS

In the following the invention is described in detail on the basis of preferred embodiments shown in the enclosed drawings, wherein.

DETAILED DESCRIPTION OF THE PREFERRED EMBODIMENTS

Figure 1:
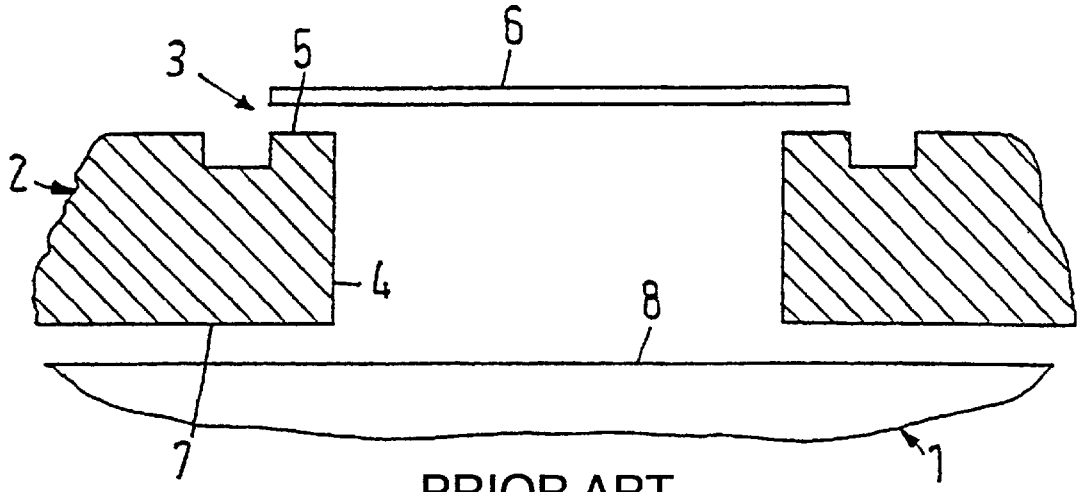
FIG. 1 is an enlarged axial section through a part of a piston-cylinder unit of a known axial piston refrigerant compressor in the area of a discharge valve.

In the known refrigerant compressor according to FIG. 1, a piston 1 is guided in a cylinder (not shown), which is closed by a valve plate 2. The valve plate 2 is provided with a schematically shown discharge valve 3, which has a cylindrical outlet opening 4 extending through the valve plate 2, with a valve seat 5 arranged on the outside of the valve plate 2 and a valve closure element 6 in the shape of a plate. To open the discharge valve 3, the valve closure element 6 is lifted from the valve seat 5 under the influence of the internal pressure within the cylinder against the force of a spring (not shown), or it is made as a leaf spring fixed on one side to the valve plate 2.

During the pressure stroke of the piston 1, that is, when it approaches its upper dead centre, the flow passing the circumference of the outlet opening 4 is confined between the inside 7 of the valve plate 2 and the front face 8 of the piston 1, accordingly, the free cross-sectional area of the flow channel to the outlet opening 4 is reduced, meaning that the flow speed during the pressure stroke with open discharge valve 3 is increased, so that recirculation zones are formed in the outlet opening, which increase the flow resistance, thus reducing the efficiency of the compressor and simultaneously increasing the noise level of the compressor during operation. The volume of the outlet opening 4 acts as "dead volume", which further decreases the compressor efficiency.

Figure 2:
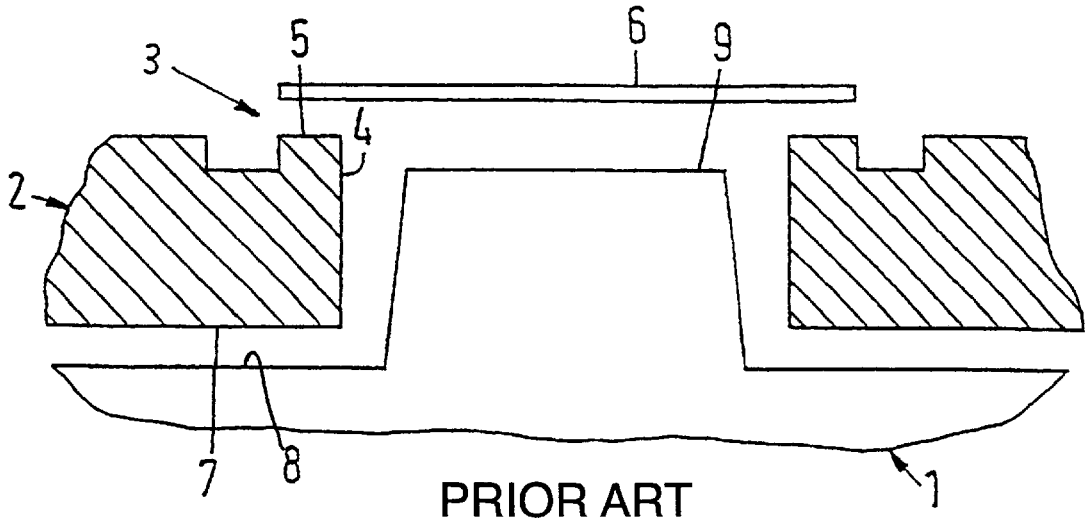
PRIOR ART Fig.2
FIG. 2 is an axial section corresponding to FIG. 1 through a further known axial piston refrigerant compressor with a front-side projection of the piston.

The known refrigerant compressor according to FIG. 2 differs from the one in FIG. 1 only in that the front face 8 of the piston 1 is provided with an approximately conically shaped projection 9, which party occupies the outlet opening 4. However, the projection 9 can already restrict the flow before the projection 9 enters into the outlet opening 4 and before the discharge valve 3 is opened. When the discharge valve 3 is opened, the flow speed of the gas, while being expelled from the cylinder by the piston 1, is maximum, so that a reduction of the cross-section area of the flow channel causes a substantial deterioration of the compressor efficiency.

Figure 3:
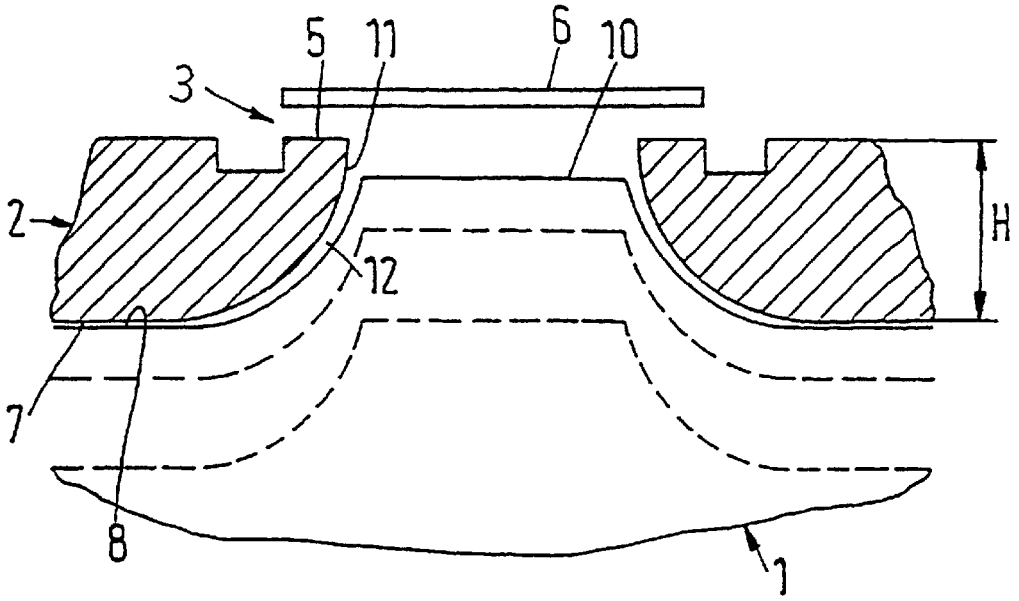
FIG. 3 is an axial section corresponding to FIG. 1 through a piston-cylinder unit of a first embodiment of a refrigerant compressor according to the invention.

Also in the embodiment in FIG. 3 of the refrigerant compressor according to the invention, the front face 8 of the piston 1 is provided with a projection 10, which partially occupies the outlet opening 11 of the discharge valve 3 in the upper dead centre of the piston 1, as shown by the unbroken border line of the piston 1. The dotted lines show the piston 1 in different lower positions.

Contrary to the known compressor according to FIG. 2, the cross-sectional area or the diameter, respectively, of the outlet opening changes over its complete height H, that is, the cross-sectional area or diameter is reduced continuously and not linearly from the inside out. In this connection, also the junction from the inside 7 of the valve plate 2 to the outlet opening 11 is rounded.

Also the cross-sectional area of the projection 10, of the piston 1 decreases continuously and non-linearly over its complete height in the direction to its free end. The same also applies for the cross-sectional diameter of the projection 10. However, the decreasing rate of the cross-sectional area of the projection 10 is somewhat larger than that of the outlet opening 11. At the same time, the junction between the plane front face 8 of the piston 1 and the circumferential surface of the projection 10 is continuous or rounded, respectively.

Between the projection 10 and the outlet opening 11 a flow channel 12 is formed, whose axial section edges are continuously curved in each axial sectional plane, and whose free cross-sectional area depends on the position of the piston 1, that is, decreases during its pressure stroke. Further, the cross-sectional area of the flow channel 12 does not change in steps, but continuously over the length of the flow channel.

When, in FIG. 3, the piston 1 moves from the lower position shown with a dotted line in the direction of the upper dead center, that is, during its pressure stroke, it reaches the middle position shown with a dotted line. In this position, the cross-sectional area of the flow channel is reduced. When, however, the piston 1 approaches the upper dead centre, its speed, and thus also the mass or volume flow of the expelled gas, is reduced. Therefore, the cross-sectional area of the flow channel 12 can be reduced without causing an increase of the pressure loss. In the upper dead center of the piston 1, which is shown with the unbroken line, the cross-sectional area of the flow channel 12 is reduced to a minimum, at the same time, however, the gas flow (mass or volume flow) has decreased. As, now, the projection 10 occupies the outlet opening 11 almost completely, the "dead volume" is reduced to a minimum, as practically the total gas amount is pressed out of the cylinder under the valve closure element 6. However, a free, yet very narrow, flow channel remains, so that even in and after the upper dead centre gas can reach the pressure outlet through the outlet opening 11 when the discharge valve 3 is open.

The reduction of the pressure loss during the emptying of the cylinder and the simultaneous reduction of the "dead volume" causes an increase of the compressor efficiency.

Figure 4:
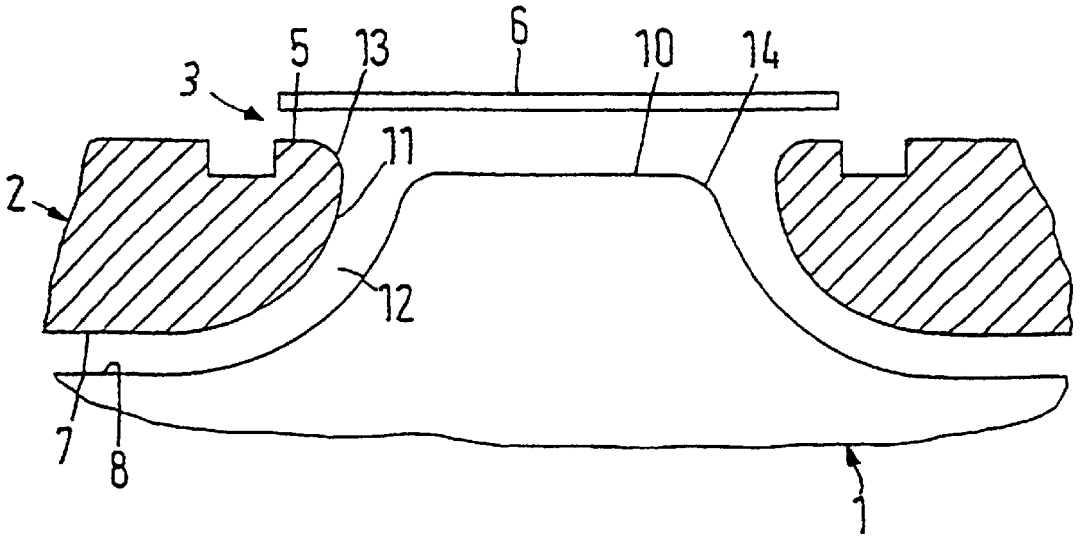
FIG. 4 is an axial section through a piston-cylinder unit of an embodiment of a refrigerant compressor according to the invention, slightly modified in relation to the embodiment in FIG. 3.

The embodiment in FIG. 4 merely differs from that in FIG. 3 in that the junction 13 between the valve seat 5 and the outlet opening 11 as well as the junction 14 between the front face of the projection 10 and its circumferential surface are continuously rounded.

The continuous junctions 13, 14 as well as the continuous junctions between the inside 7 of the valve plate 2 and the outlet opening 11 and between the front face 8 of the piston 1 and the circumferential surface of the projection 10 cause that less eddy occurs in the gas flow, meaning that the recirculation zones and the flow noises are reduced.

Figure 5:
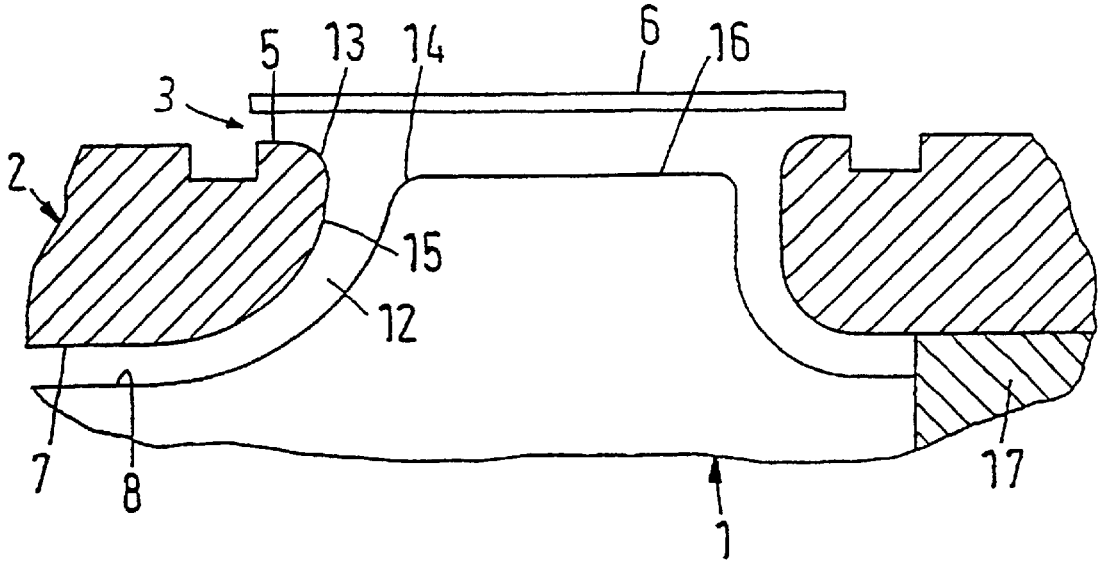
FIG. 5 is also an axial section according to the preceding figures through a part of a piston-cylinder unit of a third embodiment of a refrigerant compressor according to the invention.

In the embodiment according to FIG. 5, the outlet opening 15 of the discharge valve 3 is asymmetrical. Also the projection 16 of the piston 1 is correspondingly asymmetrical. That is, the gradients of the flanks of the outlet opening 15 and the projection 16 differ on the sides facing each other and the sides turning away from each other, respectively, to the left and to the right in the axial section view. Through these mutually adapted asymmetries of outlet opening and projection 16, the gas flows off asymmetrically from the cylinder 17. In this connection, the outlet opening 15 and the projection 16 are arranged eccentrically to the centre axis of the cylinder and at such a distance from the axis that they lie close to the wall of the cylinder 17. Otherwise, this embodiment corresponds to that of FIG. 4.

Figure 6:
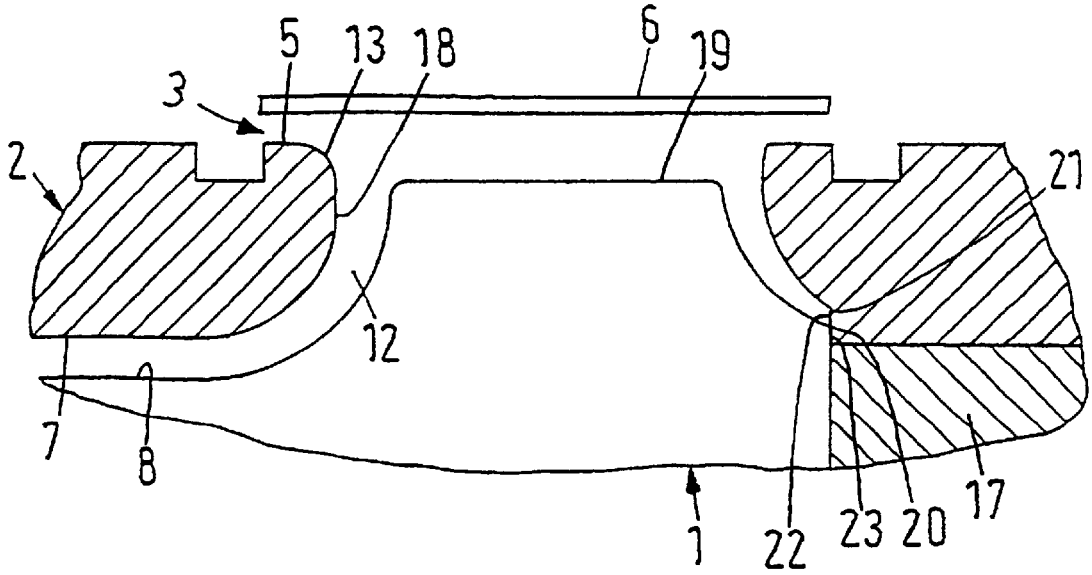
FIG. 6 is also an axial section according to the preceding figures through a part of a piston-cylinder unit of a fourth embodiment of a refrigerant compressor according to the invention.

In the embodiment in FIG. 6, the outlet opening 18 and the projection 19 are also made to be asymmetrical, so that their axial section contours substantially correspond to each other, both being arranged even closer to the wall of the cylinder 17 than is the case in the embodiment according to FIG. 5. As, during the pressure stroke with open discharge valve 3, in this case the gas flows substantially from the approximately central area of the front face 8, which is on the left in FIG. 6, to the outlet opening 18, the surfaces of the outlet opening 18 and the projection 19 facing each other near the inside of the cylinder 17 can be provided with edges 20 and 21, which change to partially cylindrical surfaces 22 and 23, respectively. Arranging the outlet opening 18 close to the inside of the cylinder 17 permits a larger diameter of both the outlet opening 18 and of the not shown suction opening in the valve plate 2.

In all embodiments, the projection 10, 16, 19 can occupy at least approximately 45% of the volume of the outlet opening 11, 15, 18.

Figure 7:
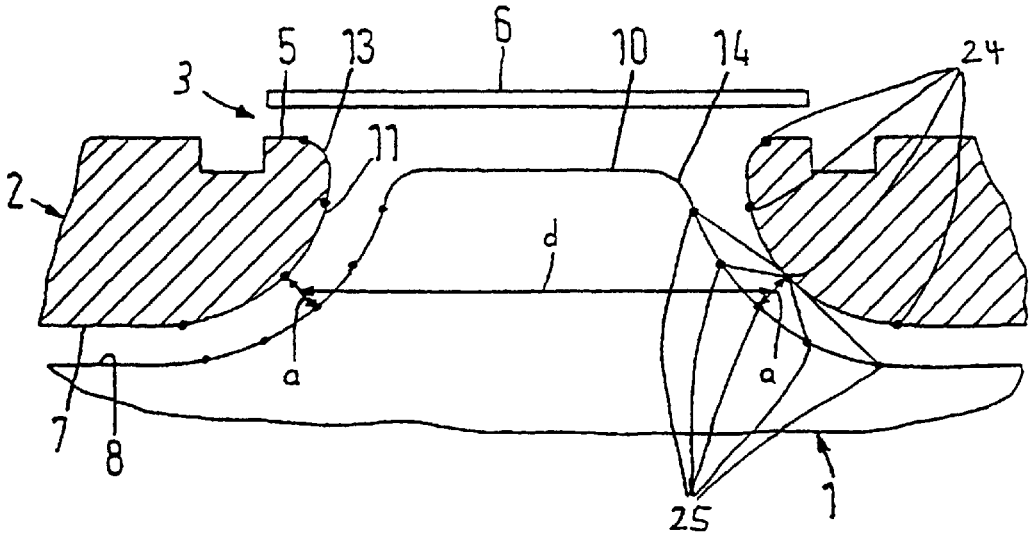
FIG. 7 is an axial section according to FIG. 4 through a piston-cylinder unit meant for clarifying the determination of the free cross-sectional area of the flow channel.

FIG. 7 clarifies the determination of the free cross-sectional area of the flow channel for a given position of the piston 1 based on the rotation symmetrical shape of outlet opening 11 and piston projection 12 shown in FIG. 4. Generally, the free cross-sectional area means the smallest geometrical cross-sectional area being available for the discharged gas and being determined by the "clearance" of the flow channel.

By way of calculation the free cross-sectional area can be determined for various extensions of the axial section edges of outlet opening 11 and piston projection 12. In this connection a number of points 24 is determined on the axial section edges of the outlet opening 11 over the total height of the valve plate 2. Also on the axial section edges of the projection 12 several points 25 are determined.

Connecting one of the points 24 on the inside of the outlet opening with a point 25 of the piston projection gives a distance a and a belonging diameter d, the diameter d corresponding to the length of the connecting line between the central points of two related distances a facing each other horizontally. According to the formula $$d_{eff}=2\cdot\sqrt{a\cdot d}$$

this gives an effective diameter $d_{eff}$ of the flow channel for a distance a. Geometrically, $d_{eff}$ can be considered as the diameter of a circular opening, which has the same cross-sectional area as the annular gap between the inside of the outlet opening and the piston projection.

Accordingly, the point 24 on the axial section edge of the outlet opening 11 is now connected with all points 25 of the projection, and values for $d_{eff}$ are determined. The lowest value found corresponds to the effective diameter of the flow channel for the point 24 in question.

The free cross-sectional area A of the flow channel 12 at a given piston position can be determined by means of the lowest overall value $d_{eff\ min}$ of the effective diameter, after determination of values for each point 24 along the inside of the outlet opening according to the procedure described above. In the case of a rotation symmetrical shape of outlet opening and projection, the following applies:

$$A = d_{eff\,\min}^2 \cdot \frac{\pi}{4}$$

Any volume V of the pressure chamber comprises the free volume in the cylinder and the volume of the dead chamber until the upper end face of the valve plate 2.

Figure 8:
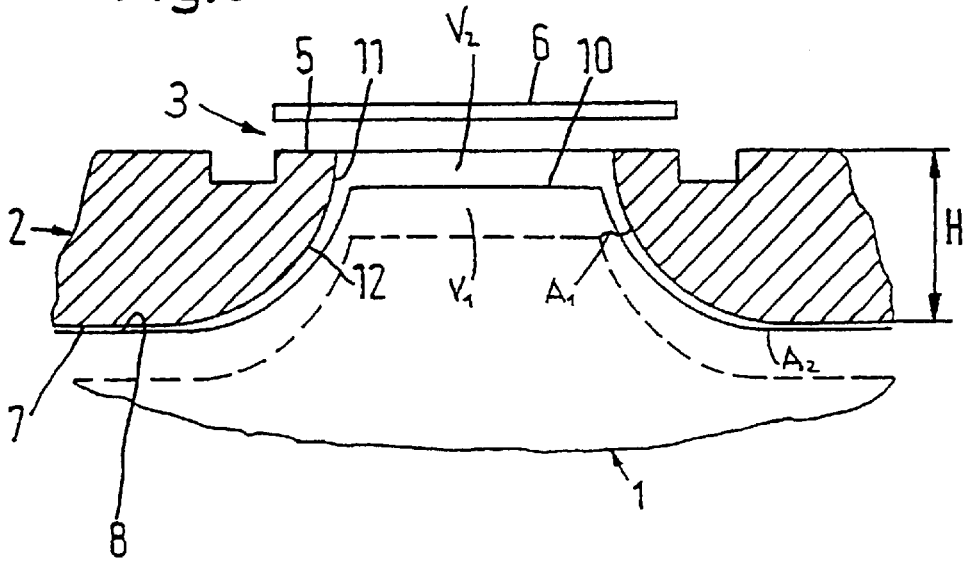
FIG. 8 is an axial section according to FIG. 3 through a piston-cylinder unit with two different piston positions.

FIG. 8 shows the alteration of the pressure chamber volume and the free cross-section of the flow channel 12 for two positions of the piston 1. In a first position, which is shown by the dotted line, a volume V1 and a free cross-sectional area A1 of the flow channel 12 occur. In the further progress of the stroke procedure the piston approaches its upper dead center and a new, lower volume V2 and a new free cross-sectional area A2 occur, A2 being situated in an area of the outlet opening close to the bottom side of the valve plate. Such a position of the piston is shown by means of the unbroken line.

The relation $$\frac{V_2}{V_1} < \frac{A_2}{A_1}$$

applies, as the volume V of the pressure chamber decreases relatively faster than the free cross-sectional area A of the flow channel 12, meaning that an increase of the flow resistance and flow noises can be avoided.

What is claimed is:

1. An axial piston refrigerant compressor comprising at least one piston-cylinder unit, whose cylinder is closed by a valve plate that has at least one discharge valve with an outlet opening, a projection of the piston extending into the outlet opening, when the piston is substantially at upper dead center, the outlet opening, the piston projection, the inside of the valve plate and the front face of the piston cooperating to delimit a flow channel defined by axial section, edges that are continuous and extend at least over the major part of any circumference defined by the flow channel, the free cross-sectional area of the flow channel being determined by a smallest cross-sectional area of the outlet opening, at least until a front face of the piston, during a pressure stroke, has reached a position, which lies below the upper dead center by at least a height (H) defined by the outlet opening, as the pressure stroke of the piston continues the free cross-sectional area of the flow channel decreases at a slower rate than the decrease of a volume defined by the pressure chamber in the cylinder and wherein, in the upper dead center position of the piston, at least 45% of a volume defined by the outlet opening is occupied by the projection.

2. An axial piston refrigerant compressor according to claim 1, wherein a cross-sectional area defined by the outlet opening decreases in the direction of an outside surface of the valve plate, the cross-sectional area defined by the projection decreases towards a free end and that the cross-sectional areas of the outlet opening and the projection change in the axial direction in such a way that during the piston movement towards the upper dead center the free cross-sectional area of the flow channel changes at a rate that is less than a rate of change in the volume remaining in the pressure chamber of the cylinder.

3. An axial piston refrigerant compressor according to claim 1, wherein during the pressure stroke of the piston, flow resistance of the flow channel can be determined by the smallest cross-sectional area defined by the outlet opening, until a free end of the piston projection is aligned with an inside surface of the valve plate.

4. An axial piston refrigerant compressor according to claim 1, wherein a junction surface defined between the valve plate and the outlet opening, and a junction surface defined between a front end of the piston and the projection are continuous, and a junction surface defined between the outlet opening and a valve seat and a junction surface defined between the projection and the piston front end are rounded.

5. An axial piston refrigerant compressor according to claim 1, wherein an axial section through the outlet opening of the valve plate and the piston projection has curved section edges.

6. An axial piston refrigerant compressor according to claim 1, wherein a junction surface defined between a valve plate surface and the outlet opening, and a junction surface defined between a front end of the piston and the projection are continuous, and a junction surface defined between the outlet opening and the valve seat and a junction surface defined between the projection and the piston front end are rounded.

* * * * *